US006851625B1

(12) United States Patent
Kuo

(10) Patent No.: US 6,851,625 B1
(45) Date of Patent: Feb. 8, 2005

(54) ATOMIZER WITH HIGH SPRAYING SPEEDS

(76) Inventor: Roy Kuo, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/795,833

(22) Filed: Mar. 9, 2004

(51) Int. Cl.[7] ..... B05B 9/043
(52) U.S. Cl. ..... 239/333; 239/338
(58) Field of Search ..... 239/333, 338; 222/321.8, 321.2, 321.1, 380, 383.1

(56) References Cited

U.S. PATENT DOCUMENTS 3,650,473 A * 3/1972 Malone ..... 239/333
3,685,739 A * 8/1972 Vanier ..... 239/333
4,643,338 A * 2/1987 Iizuka ..... 222/321.8
5,467,900 A * 11/1995 Maas et al. ..... 222/341
5,657,930 A * 8/1997 Battegazzore ..... 239/333
5,730,335 A * 3/1998 Maas et al. ..... 222/341
5,823,395 A * 10/1998 Foster et al. ..... 222/153.02
5,878,959 A * 3/1999 Smolen et al. ..... 239/121

* cited by examiner

*Primary Examiner*—Michael Mar
*Assistant Examiner*—Thach H. Bui

(57) ABSTRACT

An atomizer with high spraying speeds is disclosed. A spout has a booster chamber. One side of the spout is extended with a pumping tube. The pumping tube is formed with a guide chamber. The guide chamber has at least one expanding sub-chamber. The guide chamber is communicable to a booster chamber. A probe is placed in the guide chamber. The probe is formed with at least one stepped section. At least one boost chamber is formed with a spraying opening. A pumping tube with sliding fit encloses the booster chamber. A receiving chamber is formed between the pumping tube and the boosting chamber. A piston is assembled to the receiving chamber for pumping liquid into the receiving chamber. A triggering handle is assembled to the spout. The triggering handle is squeezable to slide into the pumping tube; and depress the piston to actuate the spraying of the liquid.

9 Claims, 6 Drawing Sheets

ATOMIZER WITH HIGH SPRAYING SPEEDS

FIELD OF THE INVENTION

The present invention relates to atomizers, and particular to an atomizer with high spraying speeds that can increase liquid speed in the spout so that when the liquid is sprayed out with a high pressure, the liquid has a higher spraying speed.

BACKGROUND OF THE INVENTION

Since the spraying speed of liquid from the atomizer is absolutely related to the atomization of the spraying liquid. The greater the spraying speed, the creation of finer liquid particle sizes resulting in a preferred atomization effect.

Besides, the currently available trigger-action atomizers serve to atomize the spraying liquid, but the spraying speed is too low to sufficiently atomize liquid so that the atomizing effect is not preferred and effective spraying coverage will reduce.

Moreover, if the atomized particles are too large, the atomized molecules cannot be distributed rapidly and evenly so that fine water drops are adhered on the spraying objects. As a result, the surfaces of the objects are drenched due to the larger particle sizes.

SUMMARY OF THE INVENTION

Accordingly, the primary object of the present invention is to provide an atomizer with high spraying speeds, wherein the atomizer can increase the speed of liquid flow.

To achieve above object, the present invention provides an atomizer with high spraying speeds which comprises a spout having a booster chamber, one side of the spout being extended with a pumping tube, an interior of the pumping tube being formed with a guide chamber; the guide chamber having at least one expanding sub-chamber; one end of the guide chamber being communicable to a booster chamber; a probe being placed in the guide chamber; the probe being formed with at least one stepped section; at least one boost chamber; the distal end of the boost chamber being formed with a spraying opening which is communicated to outer environment; a pumping tube with sliding fit enclosing an outer wall of the booster chamber; a receiving chamber being formed between the pumping tube and the boosting chamber; a suction tube being installed below the receiving chamber; a piston assembled to a lower end of the receiving chamber for pumping liquid into the receiving chamber; and a triggering handle assembled to the spout; the triggering handle being squeezable to slide into the pumping tube; and depressing the piston to actuate the liquid to be sprayed out.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
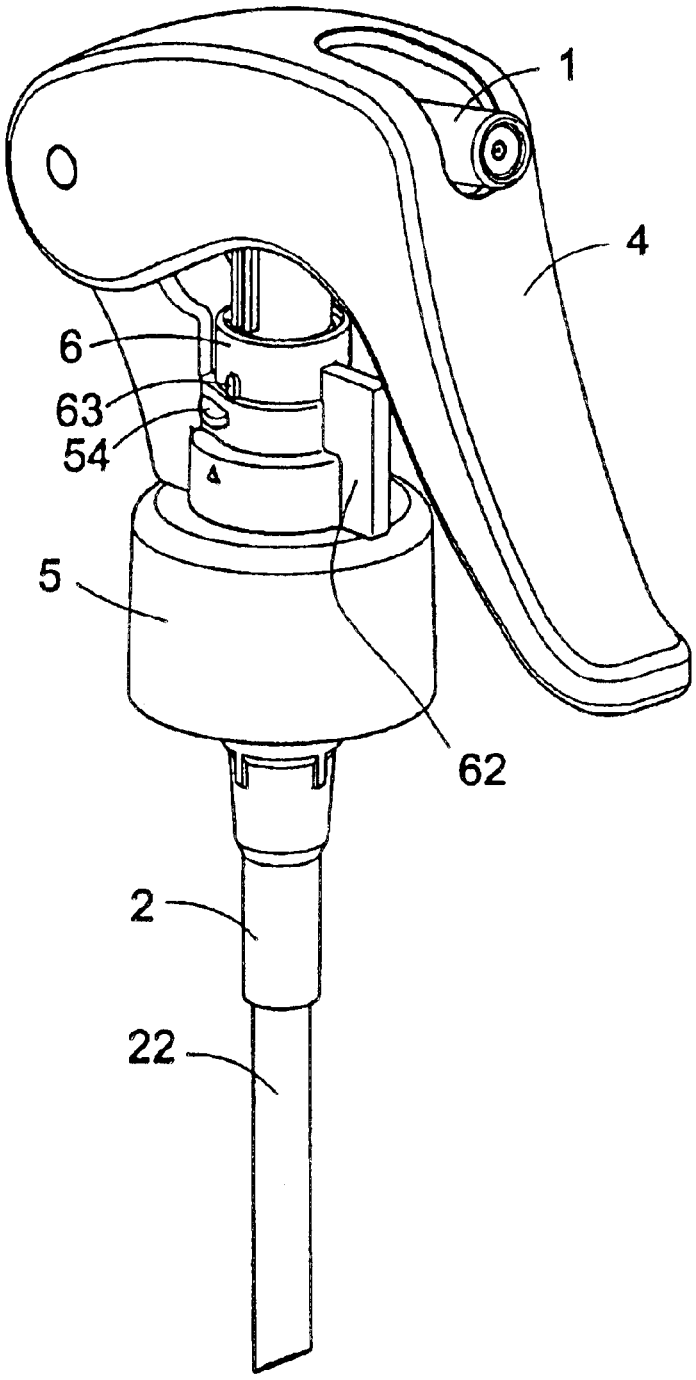
FIG. 1 is a perspective view of the present invention which comprising a spout, a pumping tube, a piston and a triggering handle so as to form a atomizer.

With reference to FIG. 1, the atomizer with high spraying speeds of the present invention is illustrated. The atomizer includes a spout 1, a pumping tube 2, a piston 3, a triggering handle 4, a rotatable cover 5 and a rotatable switch 6, as shown in FIG. 2.

Figure 2:
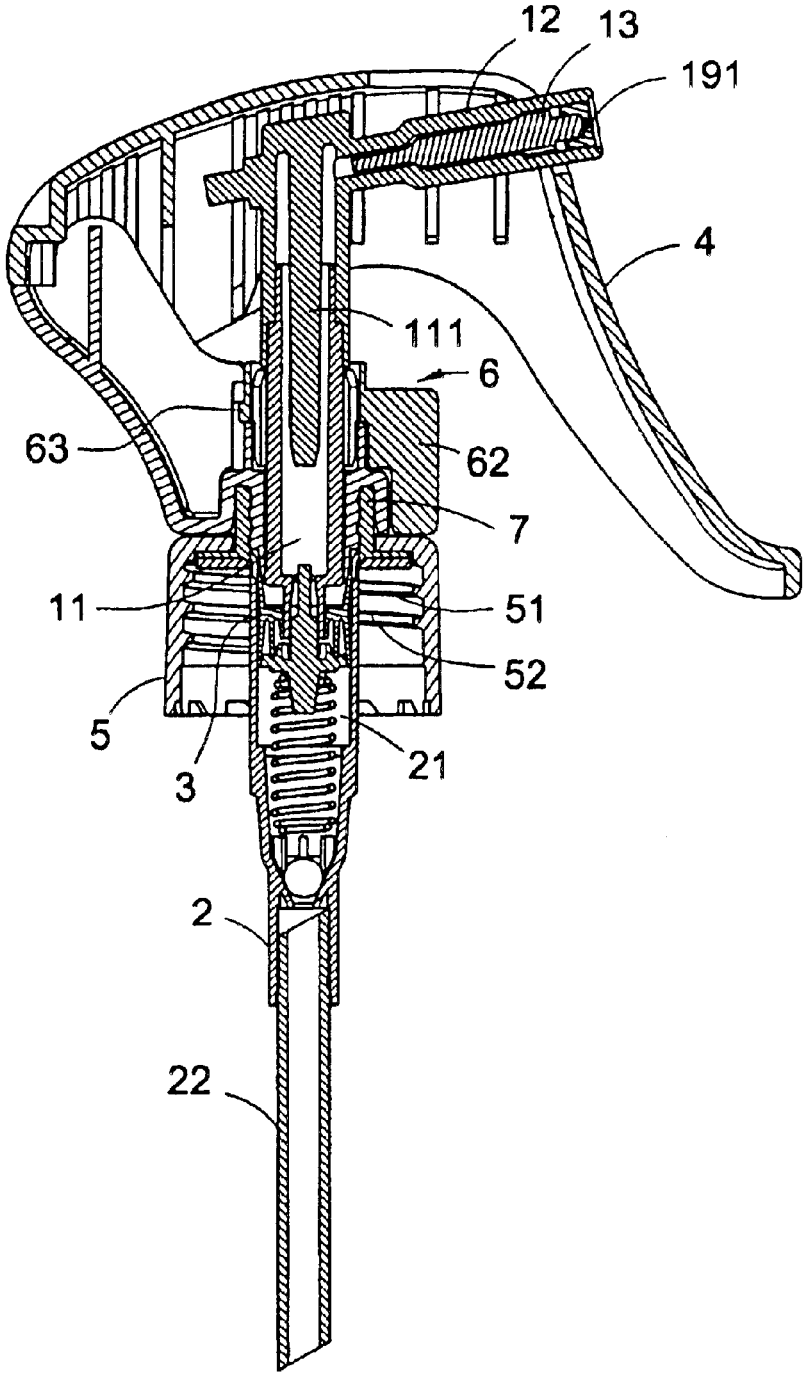
FIG. 2 is a schematic cross view of the present invention which comprising the spout, pumping tube, piston and triggering handle before actuation.
Figure 7:
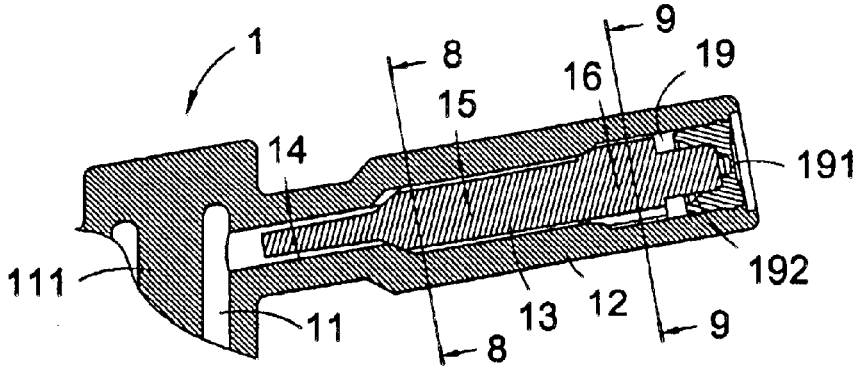
FIG. 7 is a partial schematic cross view of the embodiment of the present invention, wherein the spout, probe and a spraying opening are assembled.
Figure 8:
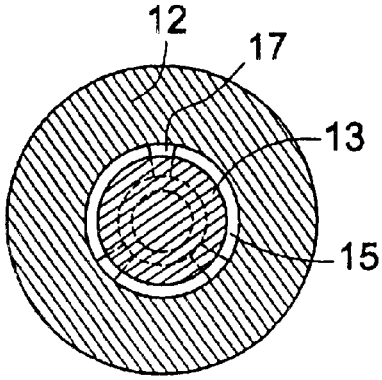
FIG. 8 is a schematic cross view along 8—8 of FIG. 7, wherein a transversal cross section is shown, where a first guide chamber is formed between a guide chamber and the probe.
Figure 9:
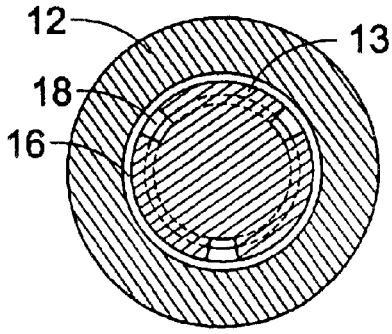
FIG. 9 is a schematic cross view along 9—9 of FIG. 7, wherein a transversal cross section is shown, where a second guide chamber is formed between the guide chamber and the probe.

The spout 1 has a stand type booster chamber 11, as shown in FIGS. 2 and 7. A top of the inner wall of the booster chamber 11 has a booster post 111, FIG. 2. One side of the spout 1 is extended with a spraying tube 12. An inner side of the spraying tube 12 is formed with a guide chamber 120 having a three stepped expanding sub-chamber (referring to FIG. 4). A tapered surface is formed between two adjacent stepped expanding sub-chambers. A tapered surface 124 between a first expanding sub-chamber 121 and a second expanding sub-chamber 122 is formed with a plurality of first flow guide chambers 17 which are spaced with an equal distance, see FIG. 8. One end of the guide chamber 120 is communicable to the booster chamber 11. A probe 13 is inserted into the guide chamber 120 (referring to FIG. 7). The probe 13 is formed with three stepped sections (referring to FIG. 10). Every two adjacent section is formed with a tapered surface 134. A tapered surface 134 formed between the second section 132 of the probe 13 and the third section 133 of the probe 13 is formed with a plurality of a second guide chamber 18 which are spaced with an equal distance (referring to FIG. 9). Between the first section 131 of the probe 13 and the first expanding sub-chamber 121 of the guide chamber 120 is formed with an annular first boosting chamber 14 (referring to FIGS. 4, 7 and 10). Between the second section 132 of the probe 13 and the second expanding sub-chamber 122 of the guide chamber 120 is formed with an annular second boosting chamber 15. Between the third section 133 of the probe 13 and the third expanding sub-chamber 123 of the guide chamber 120 is formed with an annular third boosting chamber 16. The area of the first boosting channel 14 is larger than that of the second boosting chamber 15 and area of the second boosting chamber 15 is larger than that of the third booster chamber 16. A distal end of the third section 133 of the probe 13 is reduced inwards as a stepped reduced section 135. A pressure accumulator 19 is formed between the reduced section 135 and an inner wall of the spraying tube 12. One end of the pressure accumulator 19 is formed with a spraying opening 191 that is communicated with external environment. An inner wall of the spraying opening 191 is formed with a plurality of pressure accumulating slots 192 which are spaced with an equal distance.

The pumping tube 2 encloses an outer wall of the booster chamber 11 of the spout 1 (referring to FIGS. 2 and 7) and is combined with the booster chamber 11 to be formed with a receiving chamber 21. A lower side of the receiving chamber 21 is assembled with a suction tube 22.

The piston 3 is assembled at a lower end of the receiving chamber 21 (referring to FIG. 2) for sealing receiving chamber 21 so as to store liquid.

The handle 4 is assembled to the spout 1, as shown in FIG. 2. When the handle 4 is squeezed, it will slide downward so as to enter into the pumping tube 2 to drive the piston 3 so as to spray liquid in the tube.

The rotatable cover 5 is assembled to an outer periphery of the pumping tube 2 (referring to FIG. 2) and has an annular locking chamber 51. A wall of the locking chamber 5 is installed with inner teeth 52 for being locked to a container. An annular sleeve 7 protrudes from the rotatable cover 5. A stopper 54 is installed on the top of the rotatable cover 5 (referring to FIG. 1).

Figure 6:
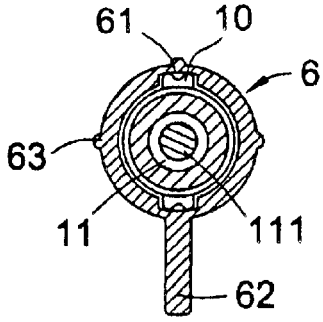
FIG. 6 is a schematic cross view along line a—a of FIG. 4, which illustrates a transversal cross section when the rotatable switch is opened.

The rotatable switch 6 is pivotally installed to the annular sleeve 7 of the rotatable cover 5 (referring to FIG. 2) and encloses the outer wall of the pumping tube 2. Two vertical sliding recesses 61, as shown in FIG. 6, corresponding to the sliding block 10 of the spout 1 are formed at the positions that the rotatable switch 6 adjacent to the pumping tube 2. One side of the rotatable switch 6 is extended with an adjustable block 62 and a buckling block 63.

By above components, the liquid pressure in the head will be increased effectively so that liquid is sprayed out with a higher pressure so as to increase the spraying speed of the liquid.

Figure 5:
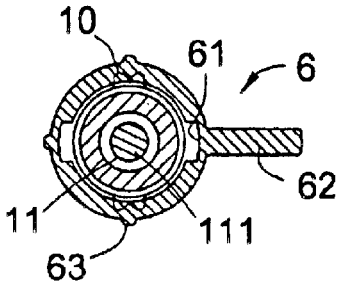
FIG. 5 is a schematic cross view along line a—a of FIG. 4, which illustrates a transversal cross section when the rotatable switch is closed.

When it is desired to spray liquid by pressing the atomizer, the adjustable block 62 of the rotatable switch 6 must be rotated firstly, as shown in FIGS. 5 and 6 so that the adjustable block 62 contacts the stopper 54 of the rotatable cover 5, see FIGS. 1 and 6. At this moment, the two sliding recesses 61 of the rotatable switch 6 are vertical to the two sliding blocks 10 of the spout 1 (referring to FIG. 6) so that when the spout 1 is depressed downward by squeezing the triggering handle 4, the two sliding blocks 10 slide downwards through the sliding recesses 61 (see FIG. 3).

If the adjustable block 62 is not in contact with the stopper 54 of the rotatable cover 5, when the spout 1 is pressed to move downwards by squeezing the triggering handle 4, the two sliding blocks 10 will be stopped by the rotatable switch 6 so as not to descend further, referring to FIGS. 1, 2 and 5.

Figure 3:
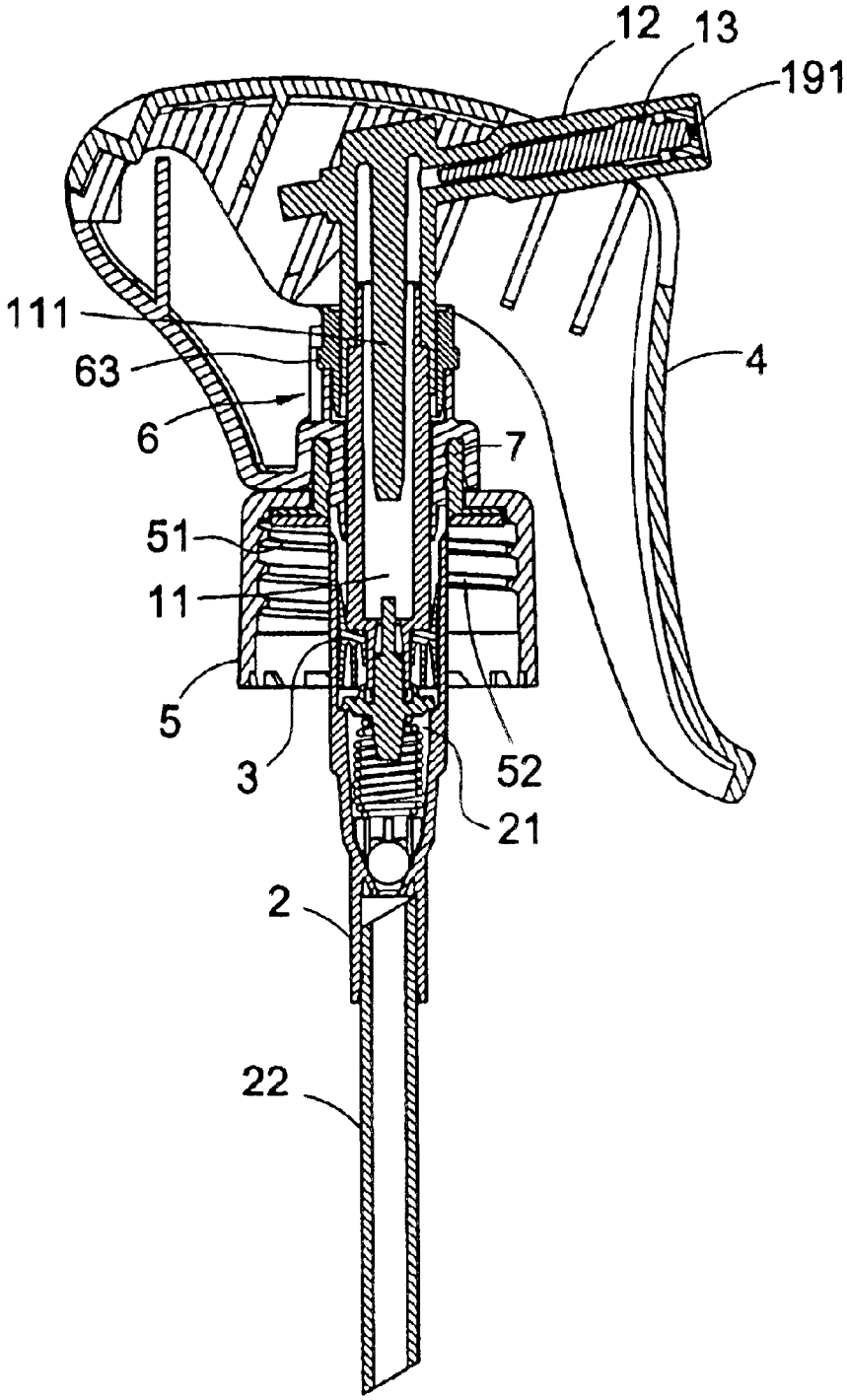
FIG. 3 is a schematic cross view of the present invention which comprising the spout, pumping tube, piston and triggering handle after actuation.

If the triggering handle 4 is squeezed, the spout 1 will slide downward by squeezing the triggering handle 4 so that the booster post 111 of the spout 1 will enter into the receiving chamber 21 to reduce the receiving volume (referring to FIGS. 2 and 3).

When the receiving space in the receiving chamber 21 reduces to some extent, the liquid original in the receiving chamber 21 will be extruded to enter into the booster chamber 11 (referring to FIGS. 2, 3 and 7) so that the pressure of the liquid is increased by the pressure from the booster post 111. Then the liquid flows into the guide chamber 120 through the booster chamber 11 (referring to FIG. 4).

When liquid flows into the guide chamber 120, the liquid will be hindered by the probe 13 firstly so as to distributed along the periphery of the probe 13 (referring to FIG. 7). The liquid flows into the second boosting chamber 15 and the third booster chamber 16 from the first boosting channel 14 between the guide chamber 120 and the probe 13 so that the speed of the liquid increases. Then the liquid flows through the first stage flow guide chamber 17 and the second guide chamber 18, referring to FIGS. 8 and 9 so that the liquid can be guided to the pressure accumulator 19. Then the liquid flows through the pressure accumulator slots 192 at one end of the pressure accumulator 19 toward the spring opening 191 and then flows out so as to increase the spraying speed of the liquid.

Since the speed of the liquid sprayed out increases, the atomized liquid sprayed out will be finer to have an atomization effect so that the effective area is increased.

Figure 4:
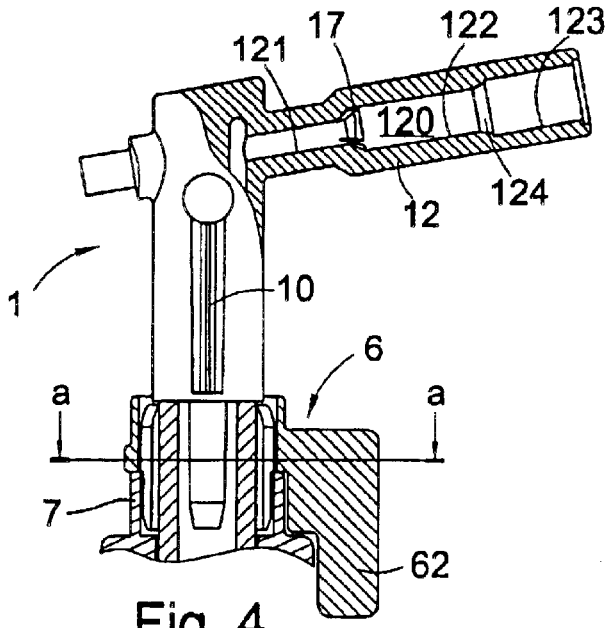
FIG. 4 is a partial schematic view of the embodiment of the present invention, wherein the structure of the spout and the rotatable switch are illustrated.
Figure 10:
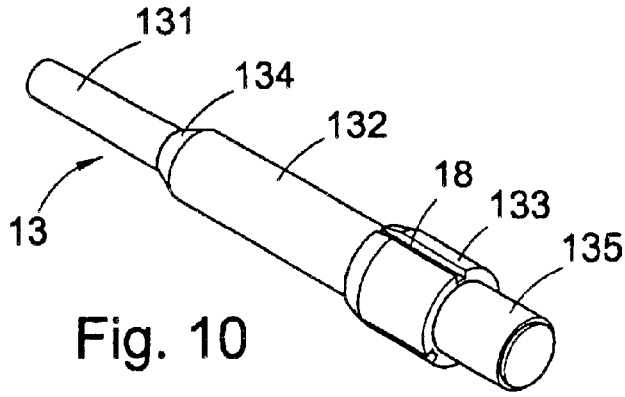
FIG. 10 is a perspective view showing the embodiment of the present invention, where the perspective view of the probe is illustrated.

The three stepped expanding sub-chambers 121, 122 and 123 of the guide chamber 120 and three stepped sections 131, 132, 133 of the probe 13, see FIGS. 4 and 10, are only examples of the present invention. The numbers of layers of the guide chamber 120 and the sections of the probe 13 are changeable. They may be single layer or multiple layers.

The present invention is thus described. It will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An atomizer with high spraying speeds comprising:

a spout having a booster chamber, one side of the spout being extended with a pumping tube, an interior of the pumping tube being formed with a guide chamber; the guide chamber having, at least one expanding sub-chamber; one end of the guide chamber being communicable to a booster chamber; a probe being placed in the guide chamber; the probe being formed with at least one stepped section; at least one boost chamber; the distal end of the boost chamber being formed with a spraying opening which is communicated to outer environment;

a pumping tube with sliding fit enclosing an outer wall of the booster chamber; a receiving chamber being formed between the pumping tube and the boosting chamber; a suction tube being installed below the receiving chamber;

a piston assembled to a lower end of the receiving chamber for pumping liquid into the receiving chamber;

a triggering handle assembled to the spout; the triggering handle being squeezable to slide into the pumping tube; and depressing the piston to actuate the spraying of the liquid.

2. The atomizer with high spraying speeds as claimed in claim 1, wherein a booster post is formed in the booster chamber.

3. The atomizer with high spraying speeds as claimed in claim 1, wherein there are more than one expanding sub-chambers; a tapered surface is formed between two adjacent expanding sub-chambers.

4. The atomizer with high spraying speeds as claimed in claim 3, wherein the tapered surface is formed with a plurality of flow guide chambers.

5. The atomizer with high spraying speeds as claimed in claim 1, wherein a tapered surface is formed between two sections of the probe.

6. The atomizer with high spraying speeds as claimed in claim 5, wherein the tapered surface is formed with a plurality of flow guide chambers.

7. The atomizer with high spraying speeds as claimed in claim 1, wherein the number of the sections of the probe is equal to that of the expanding sub-chambers of the guide chamber.

8. The atomizer with high spraying speeds as claimed in claim 1, wherein there are more than one boost chambers, the sizes of the boost chambers are sequentially enlarged.

9. The atomizer with high spraying speeds as claimed in claim 1, wherein a pressure accumulator is installed at a distal end of the probe.

* * * * *